US011395508B1

(12) United States Patent
Wahidi

(10) Patent No.: US 11,395,508 B1
(45) Date of Patent: Jul. 26, 2022

(54) SPIRAL INSERT WITH FLAVOR RELEASING MECHANISMS

(71) Applicant: Jawid Wahidi, Irvine, CA (US)

(72) Inventor: Jawid Wahidi, Irvine, CA (US)

( * ) Notice: Subject to any disclaimer, the term of this patent is extended or adjusted under 35 U.S.C. 154(b) by 0 days.

(21) Appl. No.: 17/583,039

(22) Filed: Jan. 24, 2022

(51) Int. Cl.
*A24D 3/04* (2006.01)
*A24D 3/18* (2006.01)

(52) U.S. Cl.
CPC ..... *A24D 3/048* (2013.01); *A24D 3/18* (2013.01)

(58) Field of Classification Search
None
See application file for complete search history.

(56) References Cited

U.S. PATENT DOCUMENTS 11,076,632 B1 * 8/2021 Ormaza ..... A24C 5/56

* cited by examiner

*Primary Examiner* — Dennis R Cordray
(74) *Attorney, Agent, or Firm* — Cohen IP Law Group, PC; Michael N. Cohen

(57) ABSTRACT

An insert system for use with a smokable (e.g., such as a pre-rolled or empty cone) including an internal spiral and cutout for securing one or more flavor releasing mechanisms (e.g., flavored "click balls") and for use with a smokable item (e.g., a pre-roll cone, an empty cone, a pre-rolled or hand-rolled cigarette, etc.) is provided. The insert system is formed by rolling a section of suitable material to form an elongate member with internal volume with a transverse partition. The transverse partition includes a cutout to receive and secure a flavor releasing mechanism therein. The insert system may then be coupled with a smokable to serve as the smokable's mouthpiece.

7 Claims, 11 Drawing Sheets

SPIRAL INSERT WITH FLAVOR RELEASING MECHANISMS

FIELD OF THE INVENTION

The present invention relates to smokable pre-rolls, including smokable pre-rolls with embedded flavor releasing mechanisms.

BACKGROUND

Ready-to-smoke smokables come in many forms and shapes, ranging from cigarettes to pre-rolls (e.g., pre-rolled cones as shown in FIG. 1). For those who wish to form his/her own smokable, empty cones are available into which the user adds his/her own smokable materials. In either case, the smokable oftentimes includes an insert system (such as a filter or crutch) that serves as a mouthpiece at one end of the smokable.

A new phenomenon is happening within the smokables industry involving the inclusion of flavor releasing mechanisms within the smokable insert system. In many cases, the flavor releasing mechanisms include small spheres filled with a flavoring substance (also known as "click balls") that are designed to be squeezed by the user to effectively explode and release the flavoring. However, it is oftentimes costly and labor intensive to place and secure the flavor releasing mechanism properly within the insert during the manufacturing process.

Accordingly, there is a need for an insert system that includes an easy to use system and method to incorporate one or more flavor releasing mechanisms into a smokable insert to maximize the user's smoking experience.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

For the purposes of this specification, the terms below will mean the following.

Cigarette generally refers to a smokable comprising a thin cylinder of finely cut tobacco, cannabis, other types of leaves, flowers, herbs, and/or other smokable materials, rolled in a suitable paper for smoking.

Figure 1:
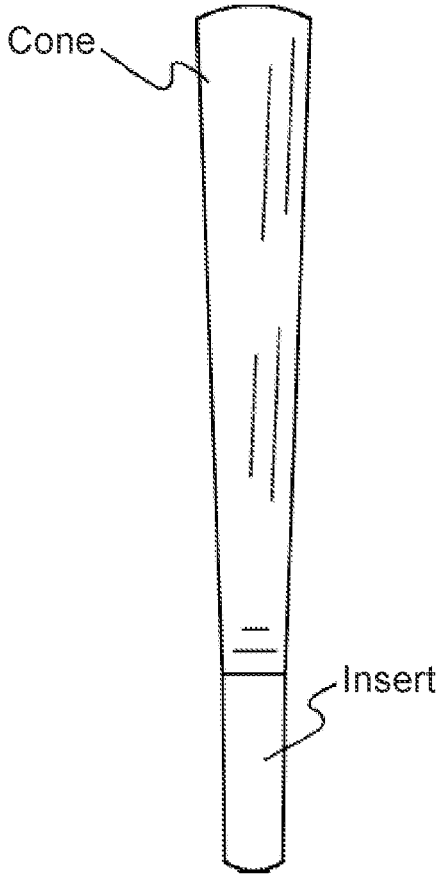
FIG. 1 (Prior Art)
FIG. 1 show aspects of a smokable cone (prior art)

Cone generally refers to a conical- or frustum-shaped cigarette (or "joint") wherein the shape flares from a smaller diameter proximal base to a larger diameter distal tip (see FIG. 1). Cones may typically comprise paper, hemp, palm leaves, rice, cotton cellulose, glycerin, and/or other suitable materials.

Pre-roll generally refers to a cigarette or cone that has been formed prior to its sale and is therefore consumer-ready (i.e., a consumer is not required to fill or otherwise form the smokable).

Empty cone refers to an empty cone into which a consumer may place smokable materials (e.g., tobacco, cannabis, etc.) to form a smokable cone.

Insert system generally refers to a mouthpiece or tip coupled with a cone or cigarette (see FIG. 1) that acts to support the proximal end of the smokable (e.g., the end that is pressed against one's lips for smoking). An insert system may include a "crutch" formed of thick paper, glass or other materials, a filter (e.g., a cotton filter), other types of insert systems, and any combinations thereof. Insert systems may be used with cigarettes, cones (pre-rolled, empty, etc.), rolling papers, and other types of smokable items.

In general, and according to exemplary embodiments hereof, an insert system 10 including an internal spiral and cutout for securing flavor releasing mechanisms (e.g., flavored "click balls") and for use with a smokable item (e.g., a pre-roll cone, an empty cone, a pre-rolled or hand-rolled cigarette, etc.) is provided. In some embodiments, the insert system with an internal spiral and cutout is provided as a standalone item for use in pre-rolling and/or hand rolling a cone or cigarette. In this case, flavor releasing mechanisms may be inserted into the insert system's internal spiral and cutout and the insert system may be coupled with the proximal end of a rolling paper or cone to form the smokable item. In other embodiments, the insert system includes (e.g., is coupled with) an empty cone and is provided to the consumer. In this case, it may be preferable that the insert system include flavor releasing mechanisms already placed within the insert system's internal spiral and cutout and ready for use by the consumer. The consumer then may fill the empty cone with smokable materials to form a smokable cone wherein the insert system is used as the cone's mouthpiece. Any combinations of these embodiments also are contemplated.

Figure 2:
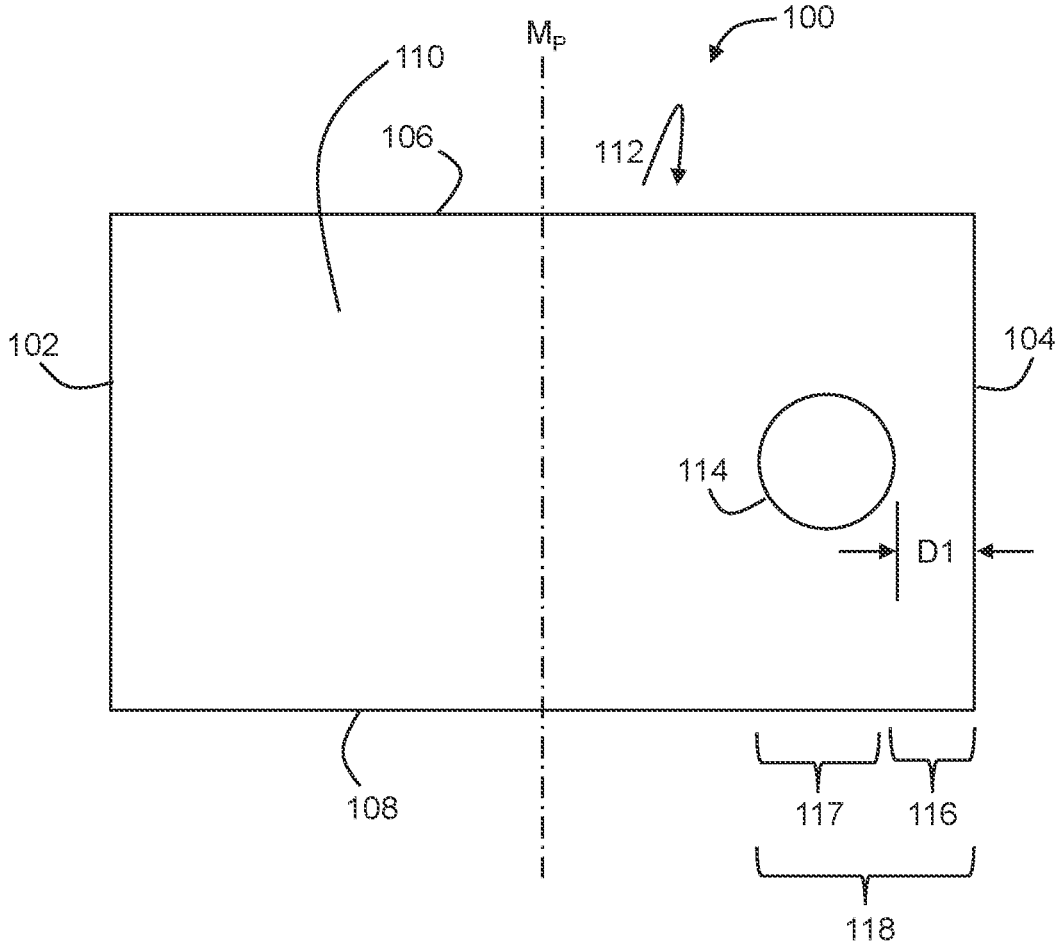
FIGS. 2-5 show aspects of a section for forming an insert system according to exemplary embodiments hereof.
Figure 6:
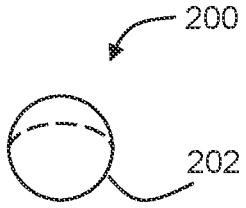
FIG. 6 show aspects of a flavor releasing mechanism according to exemplary embodiments hereof.

In one exemplary embodiment hereof as shown in FIGS. 2 and 6, the insert system 10 includes a section 100 and one or more flavor releasing mechanisms 200. As described herein, the section 100 is formed into an insert and the flavor releasing mechanism 200 is placed within the insert to form the insert system 10.

Section 100

Figure 3:
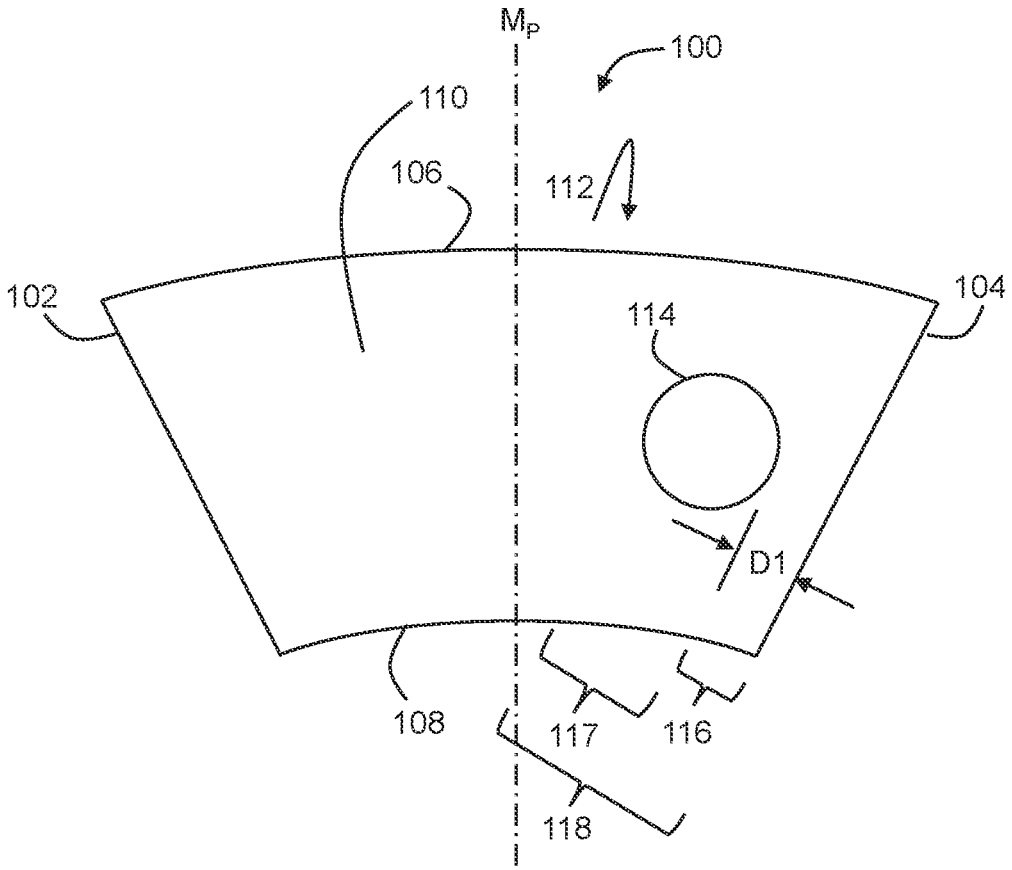

As shown in FIGS. 2 and 3, the section 100 includes a left side 102, a right side 104, a top side 106, a bottom side 108, a front 110, and a back 112. As described in other sections, the section 100 may be rolled upon itself to form an elongate member with an inner volume 113 (see FIG. 14) adapted to receive, contain, and secure one or more flavor releasing mechanisms 200.

The section 100 may comprise a flat piece of paper, cardboard, plastic, silicon, rubber, leaves, composite material(s), any other suitable material(s), and any combinations thereof. The section 100 is preferably a thin type of suitable material that is preferably non-toxic, flavorless, and burnable without adding any residual flavor to the smokable. In addition, the section 100 also is preferably porous so that it may disperse the flavoring released by the one or more flavor releasing mechanisms 200 evenly (however, this may not be necessary).

In some embodiments as shown in FIG. 2, the section 100 is generally rectangular in shape and may be used to form a generally cylindrical insert system 10. In other embodiments as shown in FIG. 3, the section 100 is shaped as an opened frustrum wherein the shape includes a leftward slanting left side 102, and a rightward slanting right side 104, a convex top side 106, and a concave bottom side 110. In this embodiment, the section 100 is used to form a generally frustum-shaped insert system 10. It is understood that the shapes described above are meant for demonstration and that the section 100 may be formed as any suitable shape (e.g., trapezoidal, etc.).

Figure 4:
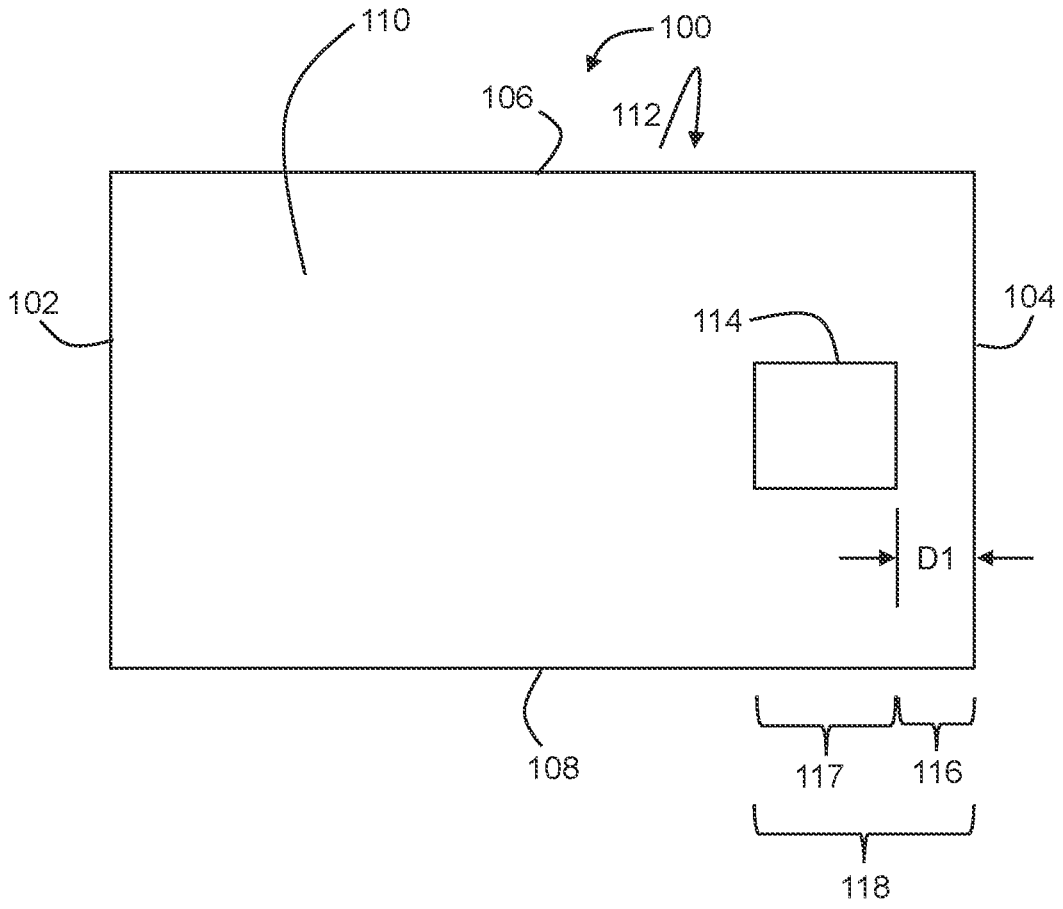
Figure 5:
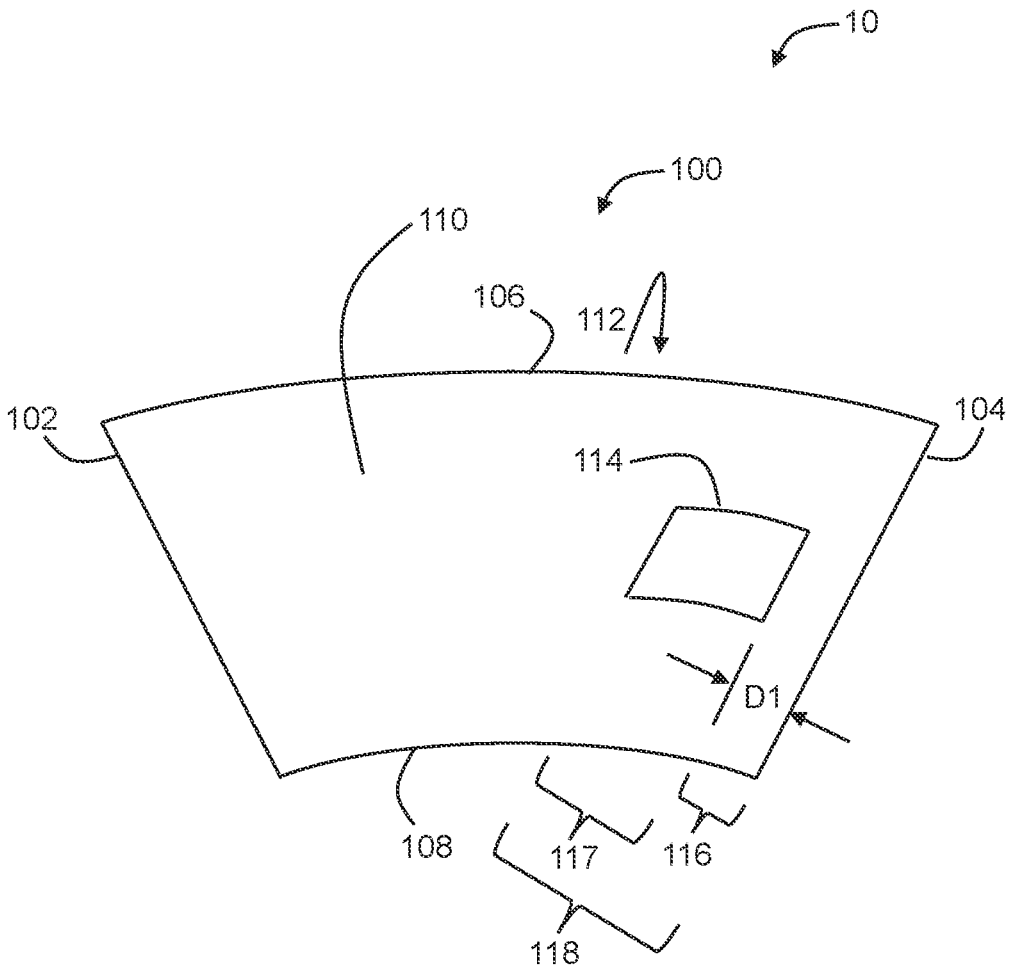

In some embodiments as shown in FIGS. 2 and 3, the section 10 includes a cutout 114 (also referred to as an aperture) in the front 110 and extending to the back 112. In some embodiments, the cutout 114 includes a generally circular shape, however, other suitable shapes also may be used. For example, as shown in FIG. 4, the cutout 14 may be rectangular or square shaped. In another example, as shown in FIG. 5, the cutout 14 may be formed as a parallelogram. It is understood that the cutout 14 may be formed as any additional suitable shape, e.g., as an opened frustum, a trapezoid, an oval, pill-shaped, as other shapes, and as any combinations thereof. As will be described in other sections, the shape and size of the cutout 114 is preferably chosen to correspond to the shape and size of the flavor releasing mechanism(s) 200 that may be secured within the cutout out 114 once the insert system 10 is formed using the section 100.

In some embodiments as shown in FIGS. 2 and 3, the section 100 includes a midpoint Mp located midway between the left side 102 and the right side 104. In some embodiments the cutout 114 is preferably located between the right side 104 and the midpoint Mp. It also is understood that the cutout 114 may be located between the left side 102 and the midpoint Mp, depending on the direction that the section 100 may be rolled as described in other sections.

In some embodiments, as shown in FIGS. 2 and 3, the cutout 114 is located at a distance D1 from the right side 104. For the purposes of this specification, the portion of the section 100 between the cutout 114 and the right side 104 having a width of D1 will be referred to as the first side portion 116, the portion extending from left side of the cutout 114 to the right side of the cutout will be referred to as second side portion 117, and the portion of the section 100 including the first and second side portions 116, 117 (and the cutout 114) will be referred to as the third side portion 118 (with the third side portion 118 having a width equivalent to the first side portion 116 plus the width of the second side portion 117).

In some embodiments, the width D1 of the first side portion 116 is chosen to facilitate the rolling of the section 100 while securing a flavor releasing mechanism within the cutout 114. For example, the width D1 may be chosen to be about 0.1 to 3 times the diameter of the cutout 114 (and/or the flavor ball 202), and preferably about 0.2 to 2 times the diameter of the cutout 114 (and/or the flavor ball 202), and more preferably about 0.3 to 1.5 times the diameter of the cutout 114 (and/or the flavor ball 202), and more preferably about 0.5 to 1 times the diameter of the cutout 114 (and/or the flavor ball 202). It also is contemplated that the cutout 114 extend all the way to the right side 104.

In some embodiments, the cutout 114 is located about midway between the top side 106 and the bottom side 108, but it is understood that the cutout 114 may be located at any suitable location between the top side 106 and the bottom side 108 (e.g., towards the top side 106 or towards the bottom side 108).

It is preferable that the size and shape of the cutout 114 generally matches the size and shape of the flavor releasing mechanism 200 (as described in other sections) so that the flavor releasing mechanism 200 fits within the cutout 114. For example, if the flavor releasing mechanism 200 is spherically shaped, it is preferable that the cutout 114 is circular with a diameter that generally matches the diameter of the mechanism 200. In any event, depending on the shape of the flavor releasing mechanism 200 and the corresponding cutout 114, it is preferable that the height and width of the cutout 114 generally matches the height and width of the flavor releasing mechanism 200 so that the flavor releasing mechanism 200 may fit within the cutout 114.

In some embodiments, the height of the cutout 116 is about 1%-50% the height of the section 100, and preferably about 3%-30% the height of the section 100, and more preferably about 10%-20% the height of the section 100, and more preferably about 12.5% the height of the section 100.

It is understood that the section 100 may include more than one cutout 114 (e.g., a second cutout 114 above or below a first cutout 114) that may be adapted to hold additional flavor releasing mechanisms 200. It is understood that any number of cutouts 114 may be included in any orientation and/or positional relationship with one another to hold any number of flavor releasing mechanisms 200.

Flavor Releasing Mechanisms 200

In some embodiments as shown in FIG. 6, the flavor releasing mechanisms 200 include any type of solid, liquid, or gas (and any combinations thereof) that may release one or more flavors when activated. The mechanisms 200 may be designed to be activated by heat (e.g., during smoking), by pressure (e.g., may be squeezed, pricked, or otherwise exploded, etc.), by other activation techniques, and by any combinations thereof.

In some embodiments as shown in FIG. 6, the flavor releasing mechanisms 200 include one or more flavor balls 202 (also referred to as click balls) comprising a crushable spherical container with a flavoring substance inside. The click balls 202 may be adapted to generally burst (or otherwise open) when squeezed thereby releasing the flavoring substance. In this way, a user may squeeze a click ball 202 embedded within the insert system 10 when a flavoring is desired during the smoking experience. While the flavor balls 202 described herein are described primarily as spherical shaped, it is understood that the flavor balls 202 may be formed as an ovoid, a cuboid, a cylinder, pill-shaped, as any other suitable shape, and as any combinations thereof. It also is understood that the cutout 114 is preferably formed to generally match or at least accommodate the shape of the flavor releasing mechanism 200 as described herein.

It is understood that any other type(s) and/or shapes of flavor releasing mechanisms 200 may be used with the insert system 10, and that the scope of the insert system 10 is not limited in any way by the type of flavor releasing mechanism(s) 200 used.

Forming and Using the Insert System

For the purposes of this specification, the forming of the insert system 10 using the section 100 and the flavor releasing mechanism 200 will be described primarily with respect to the section 100 embodiment of FIG. 7 (i.e., the embodiment of FIG. 3 as described above). However, it is understood that the methodology described herein also may be applied to any other embodiment(s) described herein or otherwise.

Figure 7:
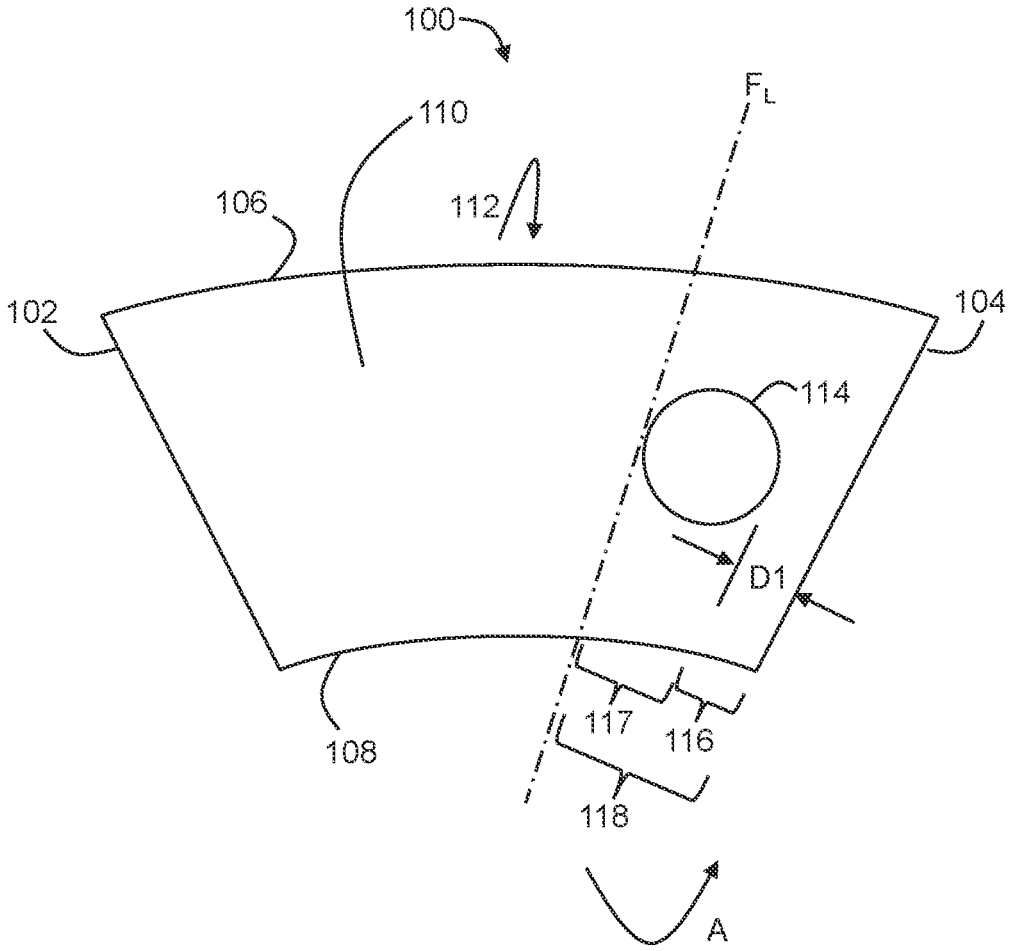
FIGS. 7-13 show aspects of a folded section including a flavor releasing mechanism for forming an insert system according to exemplary embodiments hereof.
Figure 8:
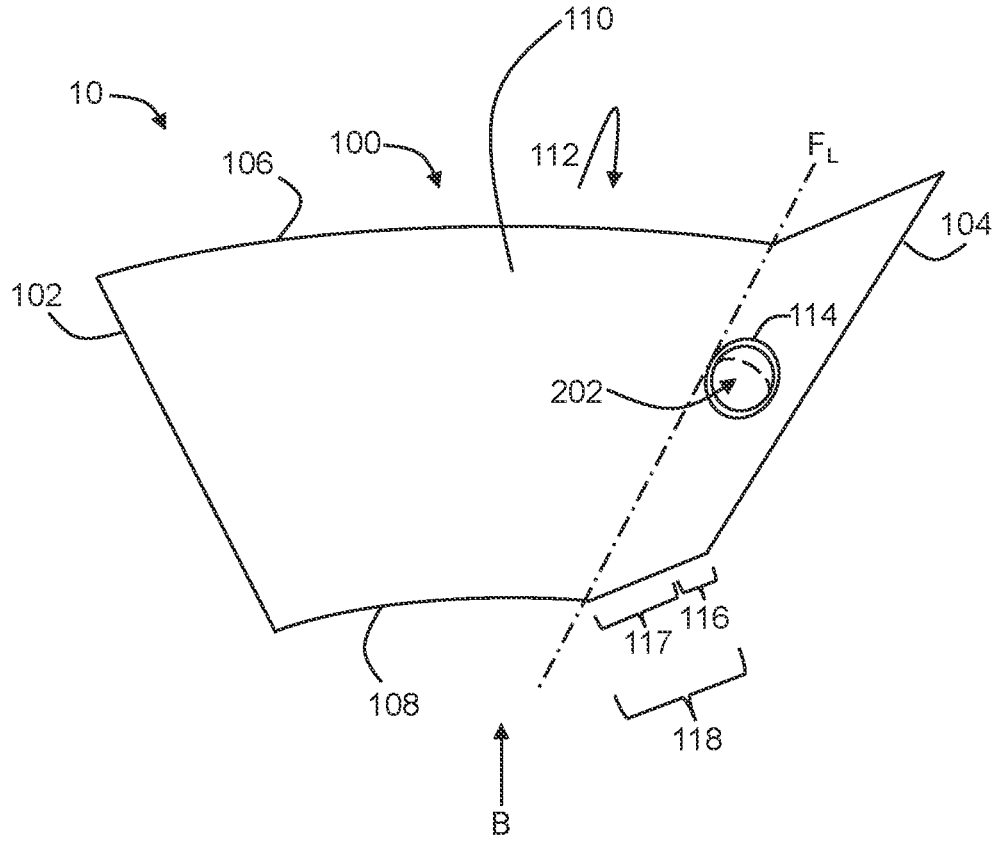

First, as shown in FIG. 7, with the section 100 generally flat, the third side portion 118 is folded upward at the fold line $F_L$ in the direction of the arrow A such that the portion 118 extends upward as shown in FIG. 8. In some embodiments, the third side portion 118 may extend upward at an angle of about 45° with respect to the unfolded portion of the section 100, but it is understood that the third side portion 118 may be folded at any suitable angle in order for the section 100 to perform its functionalities.

Figure 9:
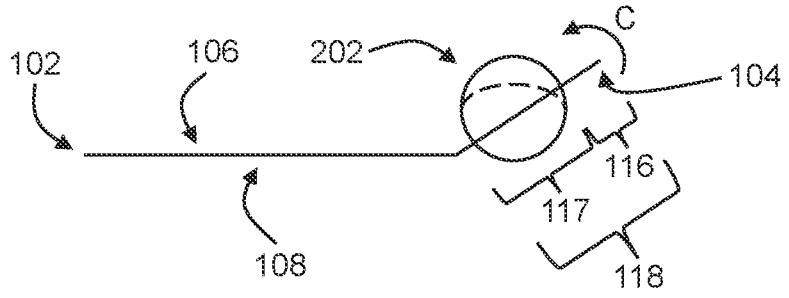

Next, the flavor releasing mechanism 200 (e.g., a flavor ball 20) is placed into the cutout 114. This results in the configuration shown in FIGS. 8 and 9. FIG. 9 shows the section 100 and flavor ball 202 of FIG. 8 taken from the perspective of the arrow B in FIG. 8.

Figure 10:
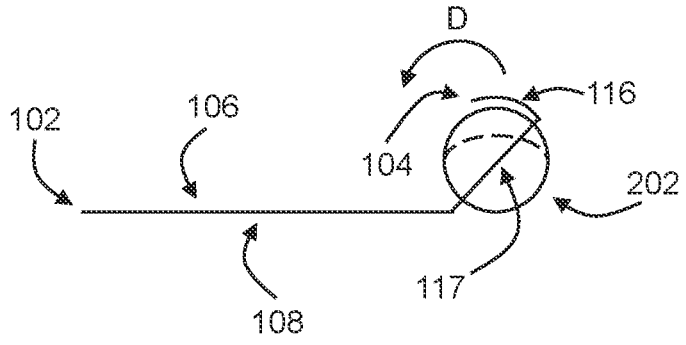

Next, as shown in FIG. 9, the first side portion 116 is folded in the direction of the arrow C resulting in the configuration shown in FIG. 10 with the first side portion 116 generally folded over an outer surface portion of the flavor ball 202 as shown. This action leaves the second side portion 117 extending transverse across the flavor ball 202 as shown in FIG. 10.

The flavor ball 202 and the second side portion 117 (including the folded first side portion 116) is next folded further along the fold line $F_L$ in the direction of the arrow D as shown in FIG. 10. This results in the configuration shown in FIG. 11.

Figure 11:
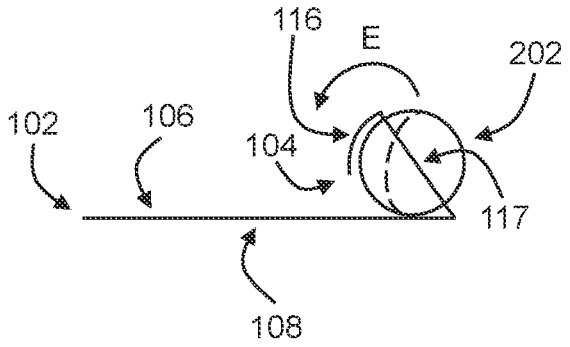
Figure 12:
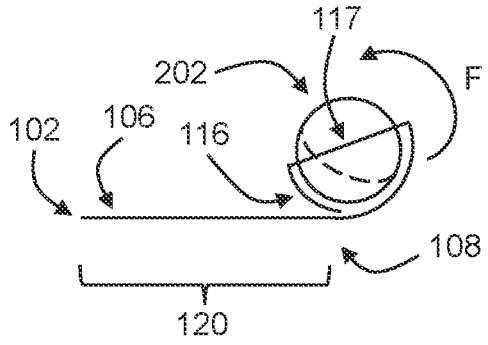

Next, as shown in FIG. 11, the flavor ball 202, the folded first side portion 116 and the second side portion 117 are rolled in the direction of the arrow E resulting in the configuration shown in FIG. 12. In this configuration, it is preferable that the right side 104 of the section 100 is tucked under the flavor ball 202 between the section 100 and the flavor ball 202 as shown. In this way, the right side 104 is held in place as originally folded over the ball 202 with the remaining portion 120 of the section 100 extending to the left as shown in FIG. 12.

Next, as shown in FIG. 12, the combination of the flavor ball 202, the first side portion 116, the second side portion 117, and any additional portion of the section 100 that extends around the outer circumference of the flavor ball 202 due to the rolling procedure described above is further rolled in the direction of the arrow F until the remaining unfolded portion 120 of the section 100 is rolled around the ball 202 forming side walls 122 of the filter 10. This results in the filter 10 depicted in FIG. 13.

Figure 13:
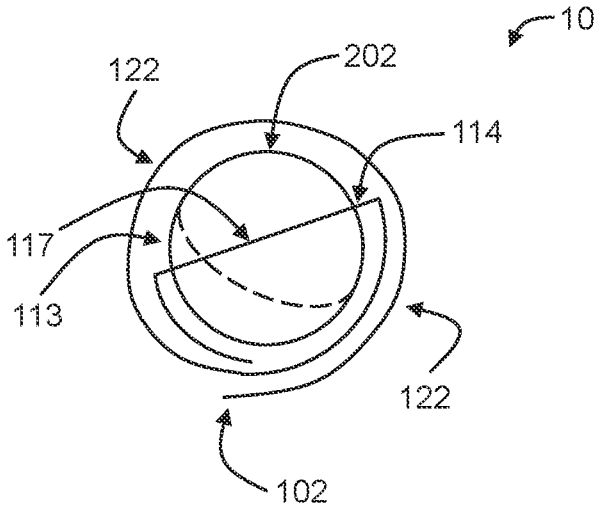

As shown in the configuration of FIG. 13, the rolling of the section 100 forming the side walls 122 creates the inner volume 113 within the rolled section 100 with the second side portion 117 extending transverse across the inner volume 113. In addition, the second side portion 117 includes a cutout 114 and a flavor ball 202 held therein.

Figure 14:
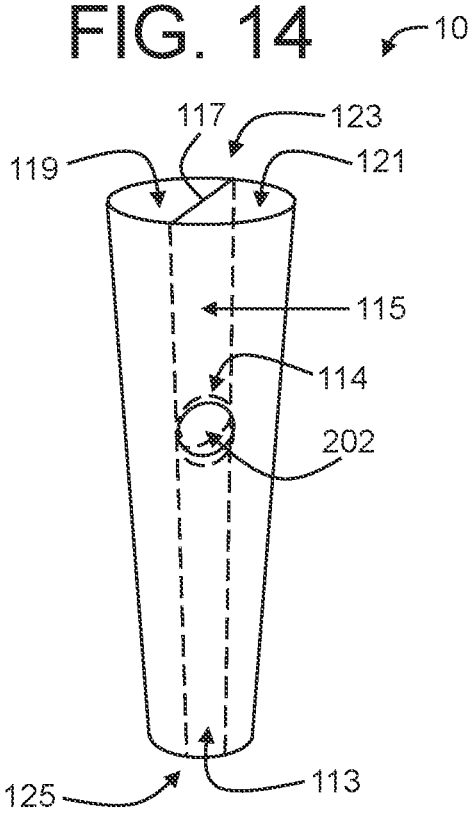
FIG. 14 show aspects of a folded section including a flavor releasing mechanism for forming an insert system according to exemplary embodiments hereof.

FIG. 14 shows a side view of the filter system 10 of FIG. 13. As shown, the folding of the second side portion 117 as described herein forms a partition 115 that divides the inner volume 113 into two elongate inner compartments 119, 121 that generally extend from a first open end 123 of the insert 10 to a second open end 125 of the insert 10. In this arrangement, the partition 115 includes at least a portion of the cutout 114. Accordingly, with the flavor ball 202 located within the cutout 114, the partition holds the flavor ball 202 in place within the inner volume 113.

Given the above, it is preferable that the length of the unfolded portion 120 of FIG. 12 be sufficient to encircle the flavor ball 202 at least once so that the sidewalls 122 hold the flavor ball 202 secure within the rolled up section 100. This may better ensure that the flavor releasing mechanism 200 is held securely within the cutout 114. However, in other embodiments, it may be sufficient for the unfolded portion 120 to only partially encircle the flavor ball 202. In this case, it may be preferable that the sidewalls 122 encircle at least enough of the flavor ball 202 to hold it secure within the resulting filter 10.

It is understood that the actions described above to form an insert system 10 using a section 100 and a flavor releasing mechanism 200 are meant for demonstration and that the method of forming the insert system 10 may include other actions not necessarily described, may not include all of the actions described, and/or any combinations thereof. For example, the insert system 10 may be formed a first time without inserting the flavor releasing mechanism 200 into the cutout 114 in order to create an empty insert system 10. The empty insert system 10 may then be at least partially unfolded (e.g., the sidewalls 122 may be unwrapped to expose the cutout 114, and to place the flavor releasing mechanism 200 into the cutout 114). The sidewalls 122 may then be rewrapped around the flavor releasing mechanism 200 to create the filter 10 and to secure the flavor releasing mechanism 200 therein.

Figure 15:
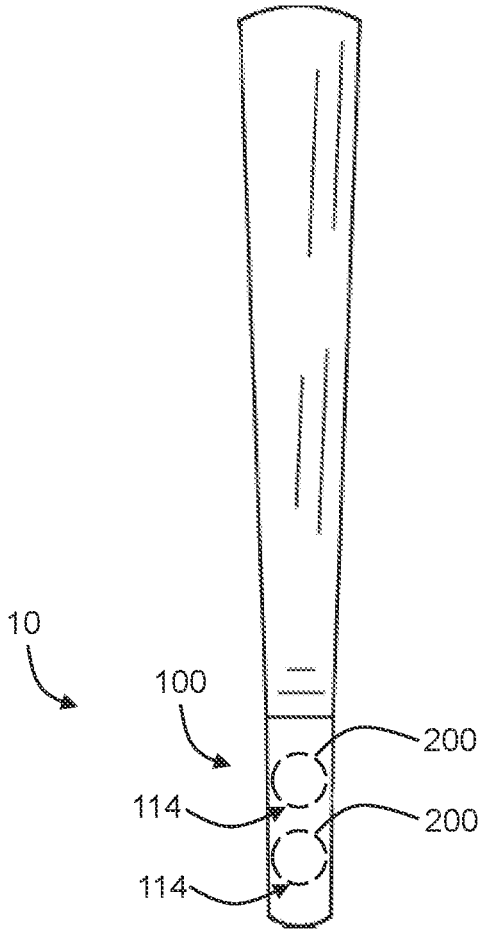
FIG. 15 shows aspects of a smokable cone configured with an insert system according to exemplary embodiments hereof.

In some embodiments as shown in FIG. 15, once the insert system 10 has been formed as described above or otherwise, it may be used as a tip, a mouthpiece, a crutch, a filter, as any type of base for a pre-roll, cone, empty cone, cigarette, other type of smokable, and for any combinations thereof as known in the art or otherwise. For example, in some embodiments, the insert system 10 may be provided to manufacturers of pre-roll cones and/or cigarettes, of empty cones, etc. to be coupled to these types of products and then sold to consumers. In another example, the insert system 10 may be coupled with a pre-roll cone and/or cigarette, and/or to an empty cone during its manufacturing and made for sale to consumers as the combination. In another example, the insert system 10 may be sold directly to consumers such that the consumers themselves may couple the insert system 10 with a rolling paper to form a cigarette, a cone, an empty cone, or other type of smokable item. It is understood that the examples described above are meant for demonstration and are non-limiting. It is notable that FIG. 15 depicts two flavor release mechanisms 200 embedded within two cutouts 114 in the filter system 10 to demonstrate that the filter system 10 may include a plurality of flavor release mechanisms 200.

It is understood that any details and/or aspects of any embodiments described herein may be combined with any details and/or aspects of any other embodiments in any way to form additional embodiment(s) all of which are within the scope of the filter 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. An insert system for use as a mouthpiece to a smokable item and for securing at least one flavor releasing mechanism, the insert system comprising:

a rolled section of material forming an elongate member with a first open end and a second open end opposite the first open end defining an inner volume extending therebetween;

a partition formed from a portion of the rolled section of material folded to traverse the inner volume from the first open end to the second open end and to separate the inner volume into at least two elongate compartments, wherein the partition is formed by a first fold in the material extending from the first open end to the second open end and a second sequential fold in the material extending from the first open end to the second open end, the first fold and the second sequential fold in the same rotational direction;

an aperture in the partition located between the first and second folds;

a flavor releasing mechanism within the aperture and held within the inner volume by the partition.

2. The insert system of claim 1 wherein the aperture includes a first side and a second side opposite the first side and the first fold is adjacent the first side and the second fold is adjacent the second side.

3. The insert system of claim 1 wherein the flavor releasing mechanism comprises a sphere filled with flavor material.

4. The insert system of claim 1 wherein the shape of the aperture is selected from the group: circular, oval, square, rectangular, parallelogram, opened frustum, trapezoidal, and pill-shaped.

5. The insert system of claim 1 wherein the elongate member is conical.

6. The insert system of claim 1 wherein the elongate member is cylindrical.

7. The insert system of claim 1 wherein the rolled section of material completely encircles the flavor releasing mechanism.

* * * * *